US008497418B2

(12) United States Patent
Roderick et al.

(10) Patent No.: US 8,497,418 B2
(45) Date of Patent: Jul. 30, 2013

(54) SYSTEM AND METHOD FOR ELECTRONIC PROCESSING OF CYMBAL VIBRATION

(75) Inventors: John V. Roderick, Marshfield, MA (US); Julia Truchsess, Sandy Hook, CT (US); Christopher Ryan, Northampton, MA (US); David McDonald, Merrimack, NH (US); Jonathan A. Marks, Summerville, MA (US)

(73) Assignee: Avedis Zildjian Co., Norwell, MA (US)

( * ) Notice: Subject to any disclaimer, the term of this patent is extended or adjusted under 35 U.S.C. 154(b) by 0 days.

(21) Appl. No.: 12/966,965

(22) Filed: Dec. 13, 2010

(65) Prior Publication Data

US 2012/0144980 A1 Jun. 14, 2012

(51) Int. Cl.
*G10H 1/12* (2006.01)

(52) U.S. Cl.
USPC ..... 84/737; 84/464 A

(58) Field of Classification Search
USPC ..... 84/464 R, 464 A
See application file for complete search history.

(56) References Cited

U.S. PATENT DOCUMENTS

| | | | | |
|---|---|---|---|---|
| 4,248,129 | A | 2/1981 | Zildjian | |
| 4,353,008 | A | 10/1982 | Dorfman | |
| 4,579,229 | A | 4/1986 | Porcaro et al. | |
| 5,056,399 | A | 10/1991 | Hornstein | |
| 5,125,134 | A | 6/1992 | Morita | |
| 5,459,283 | A | 10/1995 | Birdwell, Jr. | |
| 5,520,292 | A | 5/1996 | Lombardi | |
| 6,093,878 | A | 7/2000 | Hoshino | |
| 6,252,967 | B1 | 6/2001 | Moore et al. | |
| 6,610,916 | B1 | 8/2003 | Torrez | |
| 6,835,887 | B2 | 12/2004 | Devecka | |
| 7,015,391 | B2 | 3/2006 | Tomoda | |
| 7,488,887 | B2 | 2/2009 | Mori | |
| 7,589,275 | B2 * | 9/2009 | Arimoto | 84/723 |
| 7,608,771 | B2 | 10/2009 | Fournier et al. | |
| 7,667,130 | B2 * | 2/2010 | Mishima | 84/723 |
| 7,838,753 | B2 * | 11/2010 | Steele | 84/422.1 |
| 7,851,687 | B2 * | 12/2010 | Chang et al. | 84/464 R |

(Continued)

FOREIGN PATENT DOCUMENTS

| | | | |
|---|---|---|---|
| JP | H11-184459 | A | 7/1999 |
| JP | 2009-251477 | A | 10/2009 |

OTHER PUBLICATIONS

Korean Patent Application No. 2008-242123, filed Sep. 22, 2008. English translation.

(Continued)

*Primary Examiner* — Jeffrey Donels
(74) *Attorney, Agent, or Firm* — Nixon Peabody LLP; Khaled Shami

(57) ABSTRACT

In one embodiment, an electronic cymbal system includes a first pickup configured to generate an electrical signal representative of vibrations in a first cymbal, and a controller configured to receive the first electrical signal and to process the first electrical signal to generate an output. The controller includes a digital signal processor (DSP) configured to subject a version of the first electrical signal to a digital signal processing technique. The digital signal processing technique includes one or more of dynamic range compression, expansion, frequency equalization, harmonic excitation, comb filtering, and pitch shifting. The cymbals may be any of variety of known cymbals, such as hi-hat, crash and ride cymbals, and may be of the perforated type configured to reduce noise for indoor use. Lighting control may be provided to illuminate the cymbal for functional or aesthetic purposes.

44 Claims, 4 Drawing Sheets

U.S. PATENT DOCUMENTS

| | | | | |
|---|---|---|---|---|
| 8,063,296 | B2 * | 11/2011 | Copeland et al. | 84/645 |
| 2002/0018573 | A1 | 2/2002 | Schwartz | |
| 2003/0221545 | A1 | 12/2003 | Tomoda | |
| 2005/0126373 | A1 | 6/2005 | Ludwig | |
| 2005/0145101 | A1 | 7/2005 | Yoshino | |
| 2008/0163739 | A1 | 7/2008 | Mori | |
| 2009/0007754 | A1 | 1/2009 | May | |
| 2009/0179522 | A1 | 7/2009 | Cappello et al. | |
| 2009/0225021 | A1 | 9/2009 | Ye et al. | |
| 2010/0177516 | A1 | 7/2010 | Chang et al. | |
| 2010/0180750 | A1 | 7/2010 | Steele | |
| 2012/0060669 | A1 | 3/2012 | Ryan et al. | |
| 2012/0060670 | A1 | 3/2012 | Truchsess | |
| 2012/0186419 | A1 | 7/2012 | Roderick et al. | |

OTHER PUBLICATIONS

Korean Patent Application No. 2008-312097, filed Dec. 8, 2008. English translation.

"Traps Drums, Portable Acoustic and Electronic Drums," retrieved from www.trapsdrumsusa.com, Apr. 2010.

International Search Report and Written Opinion in PCT Application No. PCT/US11/62959, mailed Apr. 4, 2012.

International Search Report and Written Opinion in PCT/US2011/051798 mailed Jan. 17, 2012.

International Search Report and Written Opinion in PCT/US2011/062964, mailed Jan. 17, 2012.

International Search Report and Written Opinion in PCT/US2011/051810, mailed Jan. 17, 2012.

Office Action in U.S. Appl. No. 13/436,683, mailed May 29, 2012.

O'Reilly et al., "Sonic Nirvana: Using MEMS Accelerometers as Acoustic Pickups in Musical Instruments," Analog Dialogue, Feb. 2009, pp. 1-4. vol. 43-02.

Office Action in U.S. Appl. No. 13/232,831, mailed Jan. 30, 2013.

Office Action in U.S. Appl. No. 13/436,683, mailed Nov. 9, 2012.

* cited by examiner

SYSTEM AND METHOD FOR ELECTRONIC PROCESSING OF CYMBAL VIBRATION

TECHNICAL FIELD

The present disclosure relates generally to musical instruments, and more particularly, to the electronic processing of sounds from musical instruments.

BACKGROUND

Cymbals have traditionally been an acoustic-only instrument. For live performance in large spaces or recording sessions, microphones are commonly used to pick up their sound for subsequent amplification and/or recording, but the intent is generally "faithful" reproduction of the natural sound of the cymbals. Occasionally a moderate post-processing effect such as reverb or equalization is applied to tailor the cymbals' sound as required or desired.

The advent of electronic drum kits has naturally given rise to "electronic cymbals." Like their drum counterparts, these devices are used as electronic "triggers,"—that is, the sound of the "cymbal" itself being struck is not amplified for listening or intended to be heard at all. The "cymbal" (or more accurately, a plastic or plastic-covered replica of a cymbal) is fabricated with a sensor of some type, producing trigger signals that initiate playback of pre-recorded "samples" of acoustic cymbals when struck. The "sound" of the electronic cymbal is changed by changing the sample(s) that are triggered by the sensor being struck. While this approach offers advantages of virtually silent operation and "authentic" pre-recorded cymbal sounds, it suffers greatly in "feel" and "expression." Drummers are accustomed to the feel of "stick-on-metal" that an acoustic cymbal provides, and the very large range of sound variation achievable by striking an acoustic cymbal in different locations with varying types of strikes, strike force, and striking objects (sticks, mallets, brushes, etc.). Practical, cost-effective sensing schemes are not available for providing the feel and range of expression that drummers are accustomed to with acoustic cymbals.

Overview

The cymbal system as described herein can use true metal cymbals or the like, providing drummers with the stick-on-metal feel they value. Sound level can be reduced to acceptable home levels by means of perforations in the cymbal metal if desired. Rather than using the cymbals as "triggers" for sampled sounds, the natural vibrations of the cymbals themselves are converted to electrical signals by means of close-range microphones, contact microphones, or other type (optical, magnetic, etc.) of pickup device, providing isolation of each cymbal's sound from other cymbals in the drum kit. The outputs of these pickups, which can represent the amplitude, frequency and other characteristics of the vibrations, are then sent to a controller/signal processing unit where modifications to the natural sound of the cymbals can be performed. This provides users such as drummers with something that guitarists have long been accustomed to but drummers have never had: access to a wide range of tonal variations via electronic signal processing means while retaining all the natural expressiveness of their instrument's inherent acoustical vibrations.

As described herein, an electronic cymbal system includes a first pickup configured to generate an electrical signal representative of vibrations in a first cymbal, and a controller configured to receive the first electrical signal and to process the first electrical signal to generate an output.

Also as described herein, a controller includes a first input, a digital signal processor (DSP) configured to receive, through the first input, a first electrical signal representative of vibrations in a first cymbal, and to subject the first electrical signal to a digital signal processing technique, and a first output configured to output a version of the subjected first electrical signal.

Also described herein is a method for processing cymbal sound. The method includes detecting vibrations in a first cymbal, generating a first electrical signal representative of the detected vibrations, subjecting the first electrical signal to a digital signal processing technique, and outputting a version of the subjected first electrical signal.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of an electronic cymbal system. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with this disclosure, some of the components, process steps, and/or data structures described herein may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein. Where a method comprising a series of process steps is implemented by a computer or a machine and those process steps can be stored as a series of instructions readable by the machine, they may be stored on a tangible medium such as a computer memory device (e.g., ROM (Read Only Memory), PROM (Programmable Read Only Memory), EEPROM (Electrically Eraseable Programmable Read Only Memory), FLASH Memory, Jump Drive, and the like), magnetic storage medium (e.g., tape, magnetic disk drive, and the like), optical storage medium (e.g., CD-ROM, DVD-ROM, paper card, paper tape and the like) and other types of program memory.

The term "exemplary" is used exclusively herein to mean "serving as an example, instance or illustration." Any embodiment described herein as "exemplary" is not necessarily to be construed as preferred or advantageous over other embodiments.

Figure 1:
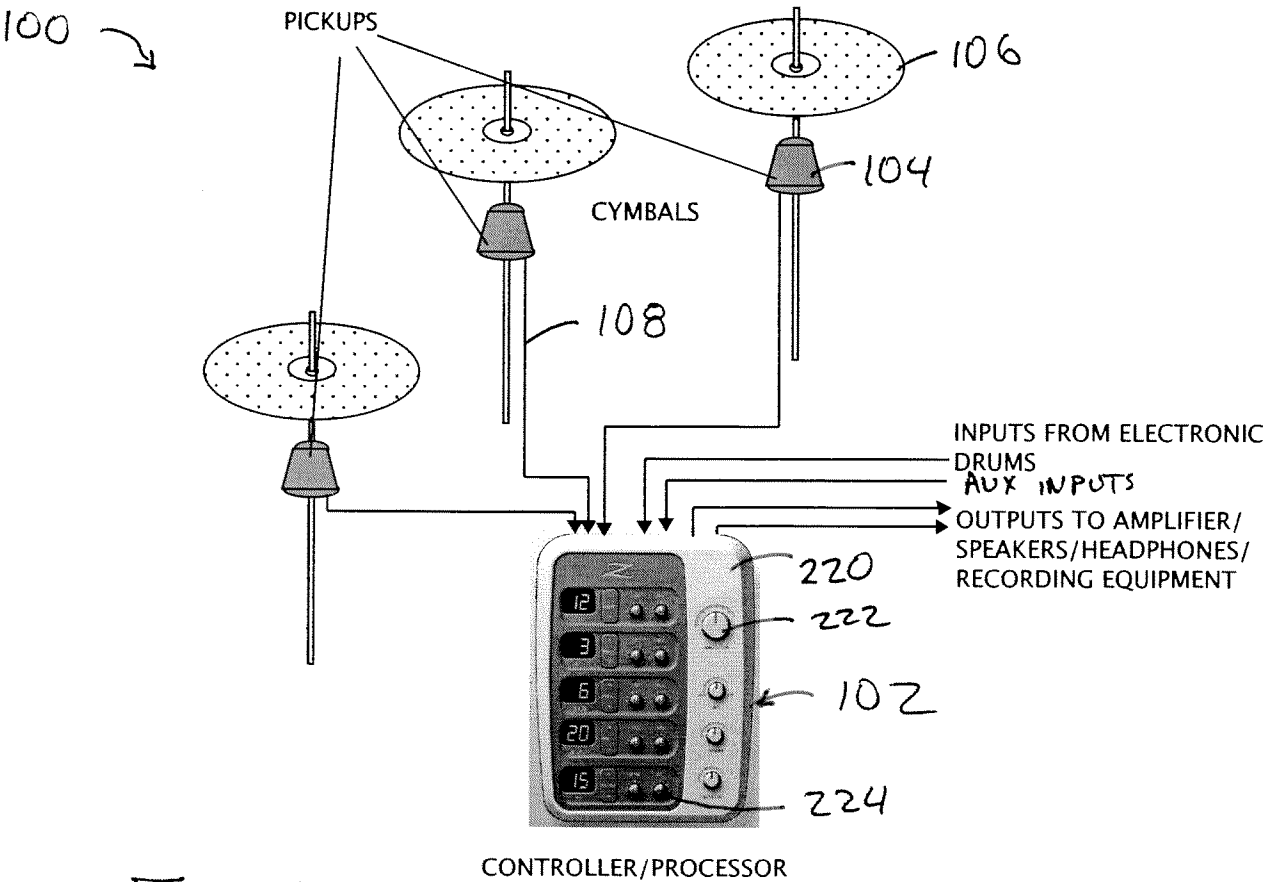
FIG. 1 is a schematic diagram of an electronic cymbal system 100 in accordance with one embodiment.

FIG. 1 is a schematic diagram of an electronic cymbal system 100. A controller 102 is coupled to a plurality of pickups 104 each serving to provide an electrical signal indicative of vibrations developed in an associated cymbal 106. The pickups 104, configured to detect features such as amplitude and frequency of vibrations and other cymbal vibration characteristics, can be any of a variety of known microphones, such as close-range microphones, contact microphones, or other types of microphones, or sensors such as optical or magnetic sensors and the like. The cymbals 106 can be any known metallic (or other percussive material) instruments, in the form of hi-hat, ride or crash cymbals, which undergo vibrations when struck by an object such as a drumstick, mallet or the like. Further, in one embodiment, the cymbals 106 are perforated with multiple holes in order to reduce or otherwise alter their sound output.

Figure 1A:
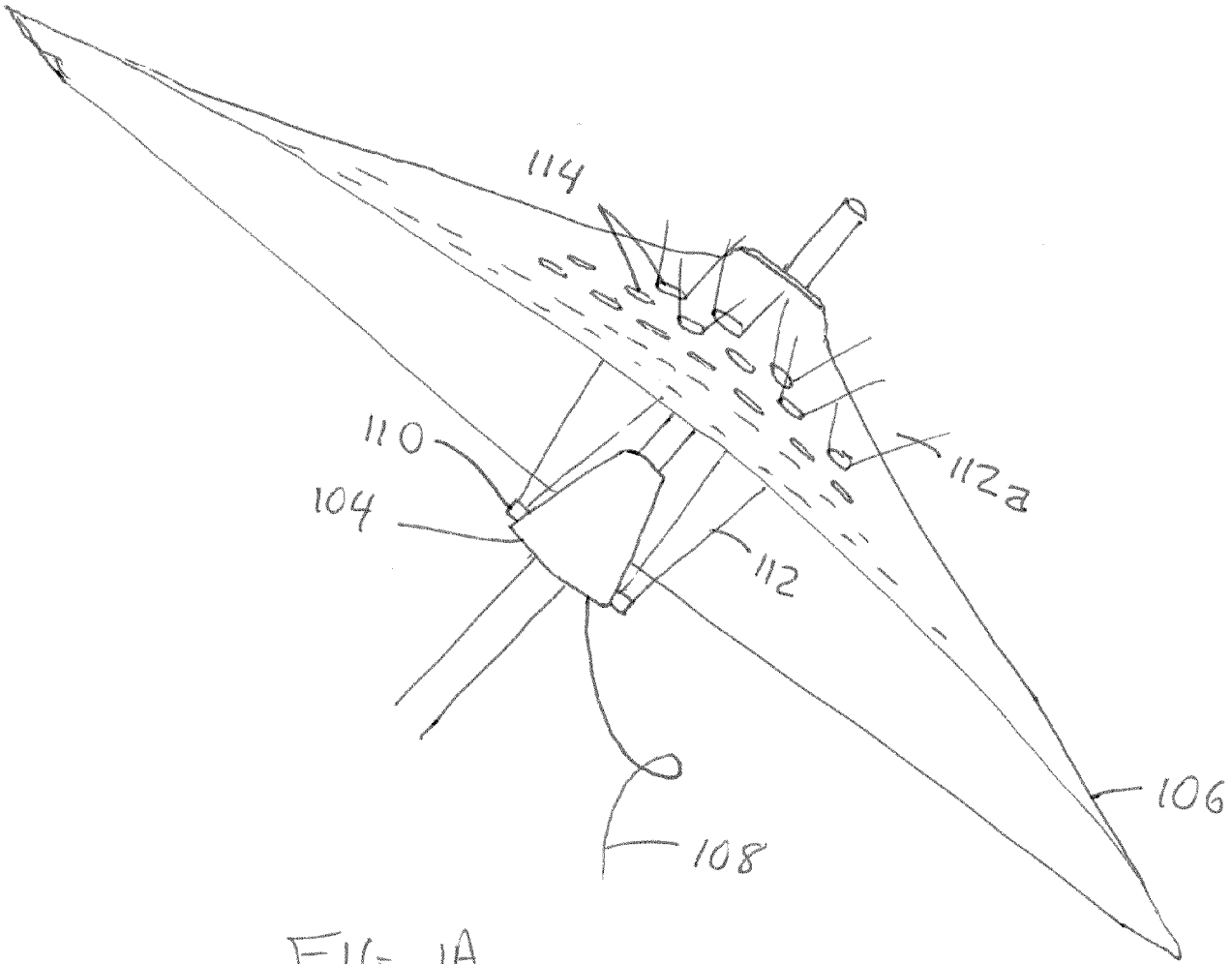
FIG. 1A is schematic diagram of a perforated cymbal lighting arrangement in accordance with one embodiment.

The connections between the pickups 104 and the controller 102 may be wireless. Alternatively, the connections may be by way of cables 108, in which case such cables can serve the additional purpose of powering lights for providing functional or aesthetic illumination to the cymbals, using for example LEDs. Such an arrangement is shown in FIG. 1A in which LEDs 110 mounted on a pickup 104 direct light 112 towards the bottom of cymbal 106 to illuminate the cymbal from below. Perforations 114 in cymbal 106 pass light from LEDs 112 upwards through the cymbal, allowing light 112*a* to emerge therethrough. The LEDs 112 may be of any desired color. Of course light sources other than LEDs are contemplated, including for instance incandescent bulbs and the like.

Figure 2:
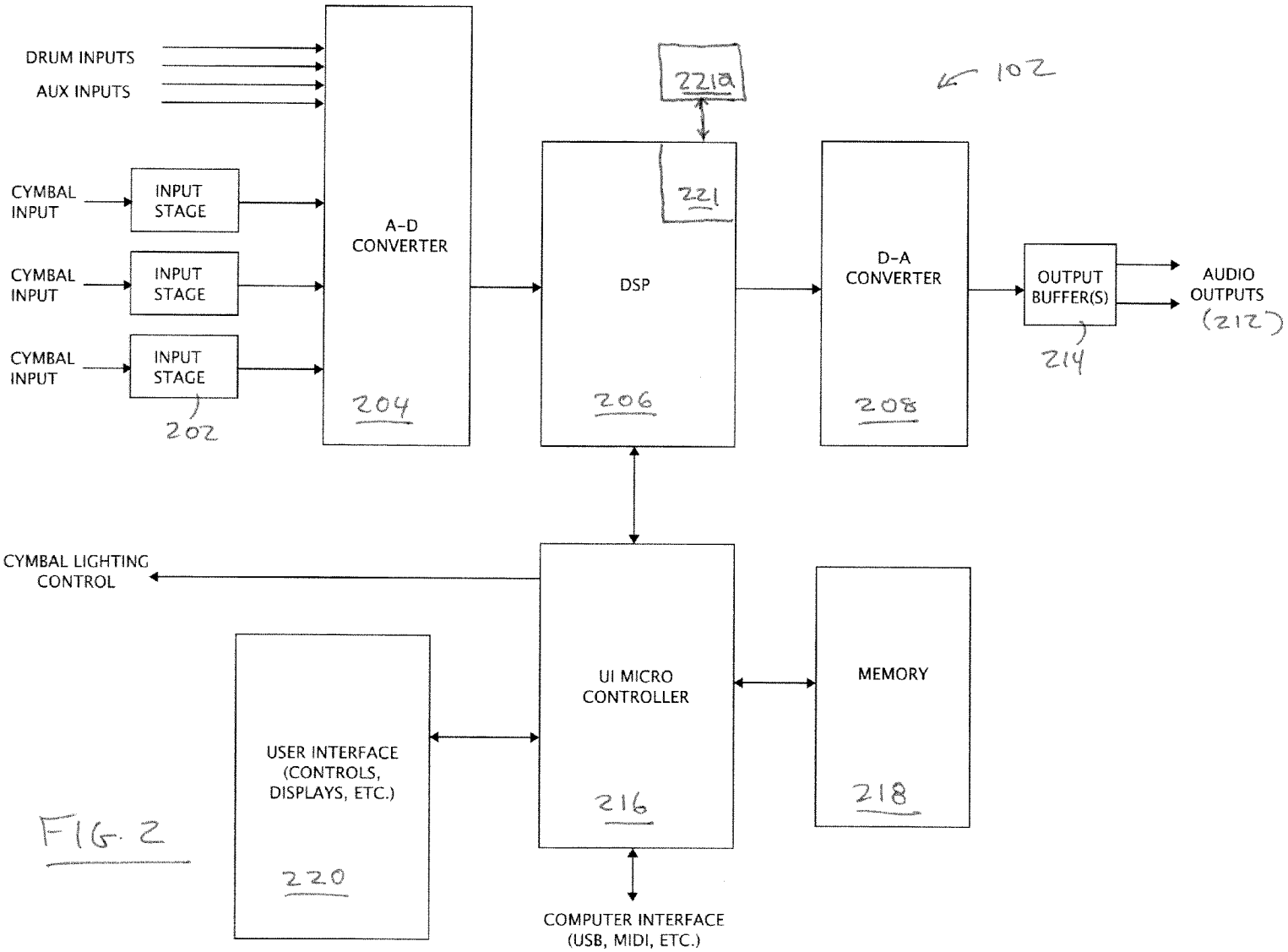
FIG. 2 is a block diagram showing portions of controller in accordance with one embodiment.

FIG. 2 is a block diagram showing portions of controller 102. Generally, operation of the controller 102 includes digitizing the real-time waveform of the cymbal's vibration, as detected by the pickups 104, in the form of for example voltage as a function of time. Frequency is implicit in this information. Once the sound waveform has been thus digitized, either time-domain or frequency-domain (or any other) DSP techniques can be applied to achieve the various processing elements desired, like filtering, dynamic range processing, harmonic excitation and so on, as detailed further below.

Returning to FIG. 2, analog signals from pickups 104 (FIG. 1) arrive at input stages 202 of the controller and are passed to A-D converter 204 for conversion into the digital domain. The digital signals are then provided to digital signal processor (DSP) 206 for processing as described further below. After said processing, the signals are optionally converted back to the analog domain via D-A converter 208 and then passed to audio outputs 212 of the controller by way of output buffer(s) 214. Alternatively, or in addition, controller 102 can output digital signals from DSP 206 without conversion to the analog domain.

Controller 102 also includes a user interface (UI) microcontroller 216 or the like coupled to the DSP 206. Microcontroller 216 is coupled to a memory 218 used for storage of data and code as necessary. Microcontroller 216 is also coupled to a UI 220, through which a user is able to provide input and instructions to the microcontroller 216 and controller 102 and to receive system information therefrom. The system information received can be conveyed in the form of lights (blinking LEDs, etc.), alphanumeric displays, display screens, sounds in the form of tones or pre-recorded or synthesized voices, and so on.

The various components of controller 102, shown independently for illustrative purposes only, might be combined in different ways. For example DSP 206 is shown separately from the A-D and D-A converters 204 and 206 and separately from the microcontroller 216. Depending on cost constraints, product feature set goals, product development strategy, component availability, and so on, however, some or all of these elements may be combined. Further, a powerful enough DSP 206 may incorporate the functionality of the UI microcontroller 216, dispensing with the need for a separate component. The UI microcontroller 216 may incorporate memory 218. It should be noted that some details of each of the various components are omitted for clarity. For instance, the DSP device can include its own dedicated memory (RAM, ROM, etc.) 221 as necessary to perform its functions. Alternatively, the memory can be a separate (or additional) component 221*a*, and can be expandable as desired.

User interface 220, shown in more detail in FIG. 1, includes means, such as knobs 222 and 224, for selecting from among multiple sets of DSP parameters, referred to herein as presets. Each preset represents a combination of DSP parameters that provide a particular cymbal sound. Different presets might be tailored for each type of cymbal—hi-hat, ride, crash, etc. Dozens, scores, or hundreds of presets can be easily provided since they consume little memory space, each typically consisting of a few dozen or a few score parameter values. A user might select, via the buttons, knobs, or other controls, among presets like "crisp hi-hat", "bright ride", "gong crash" etc. depending on the desired sound and/or effect. Information about the currently-selected presets and various other system parameters can be indicated by common display technologies such as LED's, LCD's etc. as described above. Such information, as mentioned above, can take the form of lights (blinking LEDs, etc.), alphanumeric displays, display screens, sounds in the form of tones or pre-recorded or synthesized voices, and so on.

A wide range of signal processing operations is possible by DSP techniques. Among these are dynamic range compression and expansion, frequency equalization, harmonic "exciters," comb filters, pitch shifters, and the like. These techniques are known in the art and bear no further explanation. The building blocks for these techniques are generally implemented as reconfigurable software elements or modules within the DSP's programming, although complete or partial hardware implementations are also contemplated. The parameters of the various processing blocks and the order of the blocks in the signal chain can be configured as desired via software instructions stored in a presets memory (not shown) and/or in real time via the user interface.

An example signal processing chain empirically found to work particularly well with cymbals is as follows, although other processing chains are contemplated:

Limiter->Pitch Shifter->Exciter->Parametric Equalizer->Comb Filter->Limiter

Many other processing blocks and configurations of processing blocks are possible depending on the DSP's processing speed and power.

If the presets are stored in rewritable memory (RAM, Flash ROM, EEPROM, etc.), such as memories 218, 221 and/or 221*a*, then provision can be made for user-editing of the preset parameters, either via the on-board interface controls (knobs 222 and buttons 224, for example) or remotely from a desktop PC (not shown) via a standard interface such as USB, MIDI, Ethernet, and so on.

Controller 102 also operates to manage the operation of the LEDs 110 (FIG. 1A), by way of light controller or driver 225. This operation can for example by synchronized to various rhythms or beats processed by DSP 206. Lighting control is provided by way of UI microcontroller 216 having an output that is coupled to LEDs 100 or similar light sources.

Controller 102 is also configured to receive inputs from electronic drums and other, auxiliary devices. The sounds produced by the drums for instance can be mixed with the sound of the cymbals by the DSP 206, with the resultant overall "kit mix" output for amplification and/or recording by subsequent equipment, via audio outputs 212. The signals from the cymbals and drums may be combined into a single integrated system with a consolidated user interface. The elements of the system shown here would be present, augmented by the trigger sensing, sample playback, etc. functions typical of electronic drum sets.

The auxiliary inputs ("Aux Inputs") are inputs for additional audio sources that can be mixed with the cymbal (and drum) sounds, typically from a play back device such as an mp3 player or the like, so that the user can practice by playing along with prerecorded music.

Figure 3:
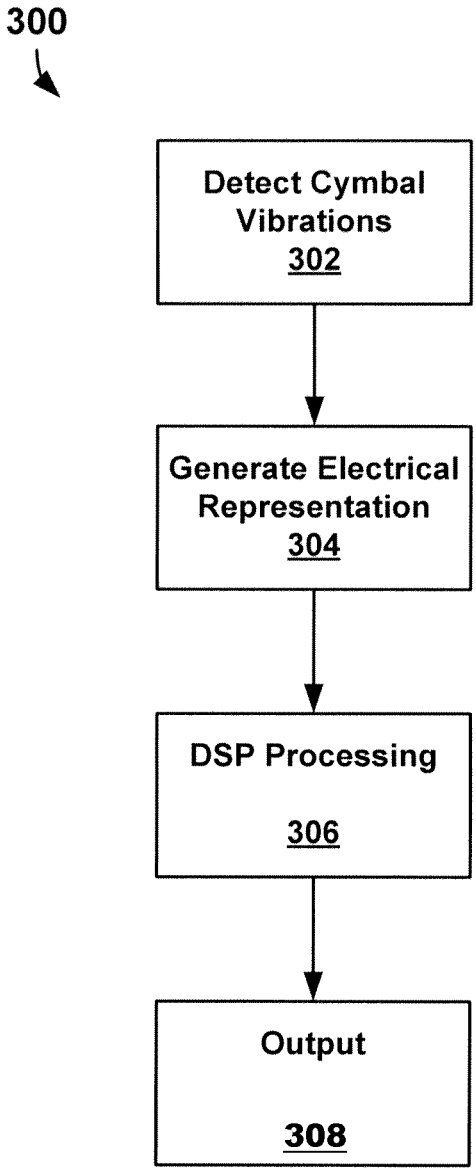
FIG. 3 is a flow diagram of a method for implementing cymbal sound processing in accordance with one embodiment.

FIG. 3 is a flow diagram of a method 300 for implementing cymbal sound processing in accordance with one embodiment. The method includes detecting, at 302, vibrations in a first cymbal, generating, at 304, a first electrical signal representative of the detected vibrations, subjecting, at 306, the first electrical signal to a digital signal processing technique, and outputting, at 308, a version of the subjected first electrical signal.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. An electronic cymbal system comprising:

a first pickup configured to generate an electrical signal representative of vibrations in a first cymbal; and a controller configured to receive the first electrical signal and to process the first electrical signal to generate an output, wherein the controller is configured to receive a second electrical signal representative of vibrations in a second cymbal and to subject a version of the second electrical signal to one or more of dynamic range compression, expansion, frequency equalization, harmonic excitation, comb filtering, and pitch shifting.

2. The system of claim 1, wherein the controller includes a digital signal processor (DSP) configured to subject a version of the first electrical signal to a digital signal processing technique.

3. The system of claim 2, wherein the digital signal processing technique includes one or more of dynamic range compression, expansion, frequency equalization, harmonic excitation, comb filtering, and pitch shifting.

4. The system of claim 1, further comprising a user interface configured to convey user commands to the controller and controller system information to the user.

5. The system of claim 4, wherein the user commands relate to selection of preset processing techniques implementable by the DSP on the first electrical signal.

6. The system of claim 1, wherein the controller is configured to receive a trigger signal associated with an electronic instrument.

7. The system of claim 6, wherein the electronic instrument is an electronic cymbal.

8. The system of claim 6, wherein the electronic instrument is an electronic drum.

9. The system of claim 1, wherein the controller is configured to receive an auxiliary audio signal.

10. The system of claim 1, wherein the output is analog.

11. The system of claim 1, wherein the output is digital.

12. The system of claim 1, wherein the cymbal is a hi-hat cymbal.

13. The system of claim 1, wherein the cymbal is a ride cymbal.

14. The system of claim 1, wherein the cymbal is a crash cymbal.

15. An electronic cymbal system comprising:

a first pickup configured to generate an electrical signal representative of vibrations in a first cymbal;

a controller configured to receive the first electrical signal and to process the first electrical signal to generate an output; and one or more light sources coupled to the controller and configured to illuminate the first cymbal.

16. The system of claim 15, wherein the one or more light sources are mounted on the first pickup.

17. The system of claim 15, wherein the processing of the first electrical signal to generate an output comprises applying a digital signal processing technique having one or more of dynamic range compression, expansion, frequency equalization, harmonic excitation, comb filtering, and pitch shifting.

18. The system of claim 15, wherein the controller includes a user interface configured to convey user commands to the controller and controller system information to the user.

19. The system of claim 18, wherein the user commands relate to selection of preset processing techniques for the first electrical signal.

20. A controller comprising:

a first input;

a digital signal processor (DSP) configured to receive, through the first input, a first electrical signal representative of vibrations in a first cymbal, and to subject the first electrical signal to a digital signal processing technique;

a first output configured to output a version of the subjected first electrical signal; and a lighting control output for outputting a lighting control signal to a light source.

21. The controller of claim 20, further comprising:

a second input, wherein the controller is configured to receive, through the second input, a trigger signal associated with an electronic instrument.

22. The controller of claim 21, wherein the electronic instrument is an electronic cymbal.

23. The controller of claim 21, wherein the electronic instrument is an electronic drum.

24. The controller of claim 20, further comprising:

a second input, wherein the controller is configured to receive, through the second input, an auxiliary audio signal.

25. The controller of claim 20, wherein the first output is an analog output.

26. The controller of claim 20, wherein the first output is a digital output.

27. The controller of claim 20, wherein the cymbal is a hi-hat cymbal.

28. The controller of claim 20, wherein the cymbal is a ride cymbal.

29. The controller of claim 20, wherein the cymbal is a crash cymbal.

30. A method for processing cymbal sound comprising:

detecting vibrations in a first cymbal;

generating a first electrical signal representative of the detected vibrations;

subjecting the first electrical signal to a digital signal processing technique;

outputting a version of the subjected first electrical signal; and outputting a lighting control signal to a light source.

31. The method of claim 30, wherein the digital signal processing technique includes one or more of dynamic range compression, expansion, frequency equalization, harmonic excitation, comb filtering, and pitch shifting.

32. The method of claim 30, further comprising providing to a user a selection of preset processing techniques that are implementable on the first electrical signal.

33. The method of claim 30, further comprising detecting vibrations in a second cymbal;

generating a second electrical signal representative of the detected vibrations in the second cymbal;

subjecting the second electrical signal to a digital signal processing technique; and outputting a version of the subjected second electrical signal.

34. The method of claim 33, wherein the digital signal processing technique to which the second electrical signal is subjected includes one or more of dynamic range compression, expansion, frequency equalization, harmonic excitation, comb filtering, and pitch shifting.

35. The method of claim 30 further comprising:

detecting a trigger signal associated with an electronic instrument.

36. The method of claim 35, wherein the electronic instrument is an electronic cymbal.

37. The method of claim 35, wherein the electronic instrument is an electronic drum.

38. The method of claim 30, further detecting an auxiliary audio signal.

39. The method of claim 30 wherein the outputted version of the subjected first electrical signal is analog.

40. The method of claim 30, wherein the outputted version of the subjected first electrical signal is digital.

41. The method of claim 30, wherein the cymbal is a hi-hat cymbal.

42. The method of claim 30, wherein the cymbal is a ride cymbal.

43. The method of claim 30, wherein the cymbal is a crash cymbal.

44. A controller comprising:

a first input;

a digital signal processor (DSP) configured to receive, through the first input, a first electrical signal representative of vibrations in a first cymbal, and to subject the first electrical signal to a digital signal processing technique;

a first output configured to output a version of the subjected first electrical signal; and a second input, wherein said controller is further configured to receive, through the second input, a second electrical signal representative of vibrations in a second cymbal and to subject a version of the second electrical signal to one or more of dynamic range compression, expansion, frequency equalization, harmonic excitation, comb filtering, and pitch shifting.

* * * * *